US006655050B1

(12) United States Patent
Lowe

(10) Patent No.: US 6,655,050 B1
(45) Date of Patent: Dec. 2, 2003

(54) SNOWBOARD BOOT WITH INFLATABLE BLADDERS

(76) Inventor: Joseph B. Lowe, 1552 LaPlaya Ave., Apt. 3-304, San Diego, CA (US) 92109

( * ) Notice: Subject to any disclaimer, the term of this patent is extended or adjusted under 35 U.S.C. 154(b) by 0 days.

(21) Appl. No.: 09/517,985

(22) Filed: Mar. 3, 2000

(51) Int. Cl.[7] ..... A43B 7/32; A43B 5/04; A43B 23/07

(52) U.S. Cl. ..... 36/93; 36/117.1; 36/117.6; 36/117.9; 36/29

(58) Field of Search ..... 36/10, 55, 71, 36/88, 89, 92, 93, 97, 117.1, 117.2, 117.6, 117.8, 117.9, 28, 29, 154

(56) References Cited

U.S. PATENT DOCUMENTS

| | | | | | |
|---|---|---|---|---|---|
| 2,830,585 | A | * | 4/1958 | Weiss | 36/93 |
| 3,750,310 | A | * | 8/1973 | Messner et al. | 36/93 |
| 3,760,056 | A | * | 9/1973 | Rudy | 36/71 |
| 4,232,459 | A | * | 11/1980 | Vaccari | 36/71 |
| 4,243,754 | A | * | 1/1981 | Swan, Jr. | 36/71 |
| 4,301,564 | A | * | 11/1981 | Dalebout | 36/93 |
| 4,662,087 | A | | 5/1987 | Beuch | 36/88 |
| 4,730,403 | A | * | 3/1988 | Walkhoff | 36/93 |
| 4,912,861 | A | * | 4/1990 | Huang | 36/71 |
| 5,113,599 | A | | 5/1992 | Cohen et al. | 36/88 |
| 5,257,470 | A | * | 11/1993 | Auger et al. | 36/88 |
| 5,416,988 | A | * | 5/1995 | Potter et al. | 36/89 |
| 5,444,926 | A | | 8/1995 | Allen et al. | 36/93 |
| 5,474,322 | A | * | 12/1995 | Perkins et al. | 36/117 |
| 5,692,321 | A | | 12/1997 | Holstine | 36/93 |
| 5,727,338 | A | | 3/1998 | George et al. | 36/93 |
| 5,765,298 | A | * | 6/1998 | Potter et al. | 36/89 |
| 5,813,144 | A | * | 9/1998 | Prengler | 36/88 |
| 6,079,129 | A | | 6/2000 | Bourdeau et al. | |
| 6,189,172 | B1 | | 2/2001 | Baek | |

FOREIGN PATENT DOCUMENTS

| | | | | |
|---|---|---|---|---|
| JP | 405095804 | * | 4/1993 | 36/88 |

* cited by examiner

*Primary Examiner*—Anthony D. Staschick
(74) *Attorney, Agent, or Firm*—Sand & Sebolt

(57) ABSTRACT

The snowboarding boot of the invention includes a boot shell having a toe portion, a heel portion, an ankle portion, and a top portion. In the preferred embodiment, a selectively inflatable bladder is disposed at each of these portions to allow the user of the snowboarding boot to selectively adjust the secureness of the fit between his foot and the boot. In one embodiment, each of the bladders is connected together so that inflation of one bladder provides fluid pressure to all of the bladders. In another embodiment, each of the fluid bladders is separate allowing the user to adjust the inflation pressure of each bladder individually.

6 Claims, 4 Drawing Sheets

SNOWBOARD BOOT WITH INFLATABLE BLADDERS

BACKGROUND OF THE INVENTION

1. Technical Field

The present invention relates generally to footwear and, more particularly, to a snowboard boot having inflatable bladders that allow the boot to securely clamp to the user's foot and ankle. Specifically, the present invention relates to a snowboard boot having a plurality of selectively inflatable bladders disposed at the ankle, the top of the foot, the toe of the foot, and the heel of the foot to allow the user to secure his foot within the boot by adjusting the pressure within the bladders.

2. Background Information

Snowboarding has increased in popularity in recent years. The rise in popularity has contributed to the improvement of snowboarding equipment. Snowboarders have also increased the difficulty of their activities by building half pipes and obstacles that increase the stress on the snowboarding equipment.

A snowboarder needs a snowboard and a pair of boots configured to be securely mounted on the snowboard. Snowboard boots are either strapped to the snowboard or are clamped to the snowboard with a clamp specially designed to hold a corresponding boot. In either arrangement, the connection between the user's foot and the snowboard boot is an important connection allowing the user's movements to be translated directly to the board and providing a safe, secure connection between the snowboarder and the snowboard.

Typical prior art snowboard boots include an interior mold that is formed around the user's foot while the user is breaking in the boot. Although some prior art molds allow the user to custom shape the mold before use, other molds are standard sizes are shaped to fit the user's foot while the user is snowboarding. One problem with molds that must be broken in is the discomfort to the user during the breaking in period. The tradeoff to the discomfort is that the snowboarder has a secure fit due to the tightness of the mold. Unfortunately, the tight fit is uncomfortable and it is difficult for the snowboarder to remove his foot from the boot when necessary. Another problem with the prior art molds is that the tight fit eventually loosens due to normal use. The constant movement of the snowboarder's foot loosens the mold over time.

A loose fitting snowboard boot is highly undesirable in the art. Loose fits between the foot and the boot lessen the snowboarder's control over the snowboard and can lead to injury of the snowboarder or others. The art thus desires to provide a snowboard boot that provides a constant tight fit between the snowboarder's foot and the boot. The art also desires that the boot be adjustable to accommodate for wear over time.

SUMMARY OF THE INVENTION

In view of the foregoing, an objective of the present invention is to provide a snowboard boot that maintains a tight, secure fit with the snowboarder's foot.

Another objective of the present invention is to provide a snowboard boot that has an adjustable fit.

Another objective of the present invention is to provide a snowboard boot having a fit that can be selectively tightened and loosened about different areas of the snowboarder's foot.

Another objective of the present invention is to provide a snowboard boot having quickly deflatable bladders allowing the snowboarder's foot to be easily inserted into and removed from the boot.

Another objective of the present invention is to provide a snowboard boot that has a plurality of selectively inflatable bladders distributed around the critical areas of the foot to allow the snowboarder to tighten and loosen the grip of the snowboard boot against different areas of his foot.

Another objective of the present invention is to provide a snowboard boot that allows the selectively inflatable bladders to be manually or automatically inflated rapidly.

Another objective of the present invention is to provide a snowboard boot that improves the comfort of the wearer.

Another objective of the present invention is to provide a snowboard boot that has improved safety and performance and improved response in the snowboard when used by a snowboarder.

Another objective of the present invention is to provide a snowboard boot having a plurality of inflatable bladders that may be inflated with a carbon dioxide cartridge.

Another objective of the present invention is to provide a snowboard boot that has a tight, secure fit that does not loosen over time.

These and other objectives and advantages of the invention including a snowboarding boot including a boot shell having a toe portion, a heel portion, an ankle portion, and a top portion; a first selectively inflatable bladder disposed at one of the portions of the boot shell; a second selectively inflatable bladder disposed at another of the portions of the boot shell; a first air inlet/release connected to the first bladder and extending outside the boot shell; and a second air inlet/release connected to the second bladder extending outside the boot shell; the first and second air inlet/releases allowing the first and second bladders to be inflated and deflated independent of each other.

Other objectives and advantages of the invention are achieved by including a boot shell having a toe portion, a heel portion, an ankle portion, and a top portion; a first selectively inflatable bladder disposed at one of the portions of the boot shell; a second selectively inflatable bladder disposed at another of the portions of the boot shell; and pump means for selectively inflating and selectively deflating the first and second selectively inflatable bladders.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended Claims.

Similar numbers refer to similar parts throughout the specification.

DESCRIPTION OF THE PREFERRED EMBODIMENTS

Figure 1:
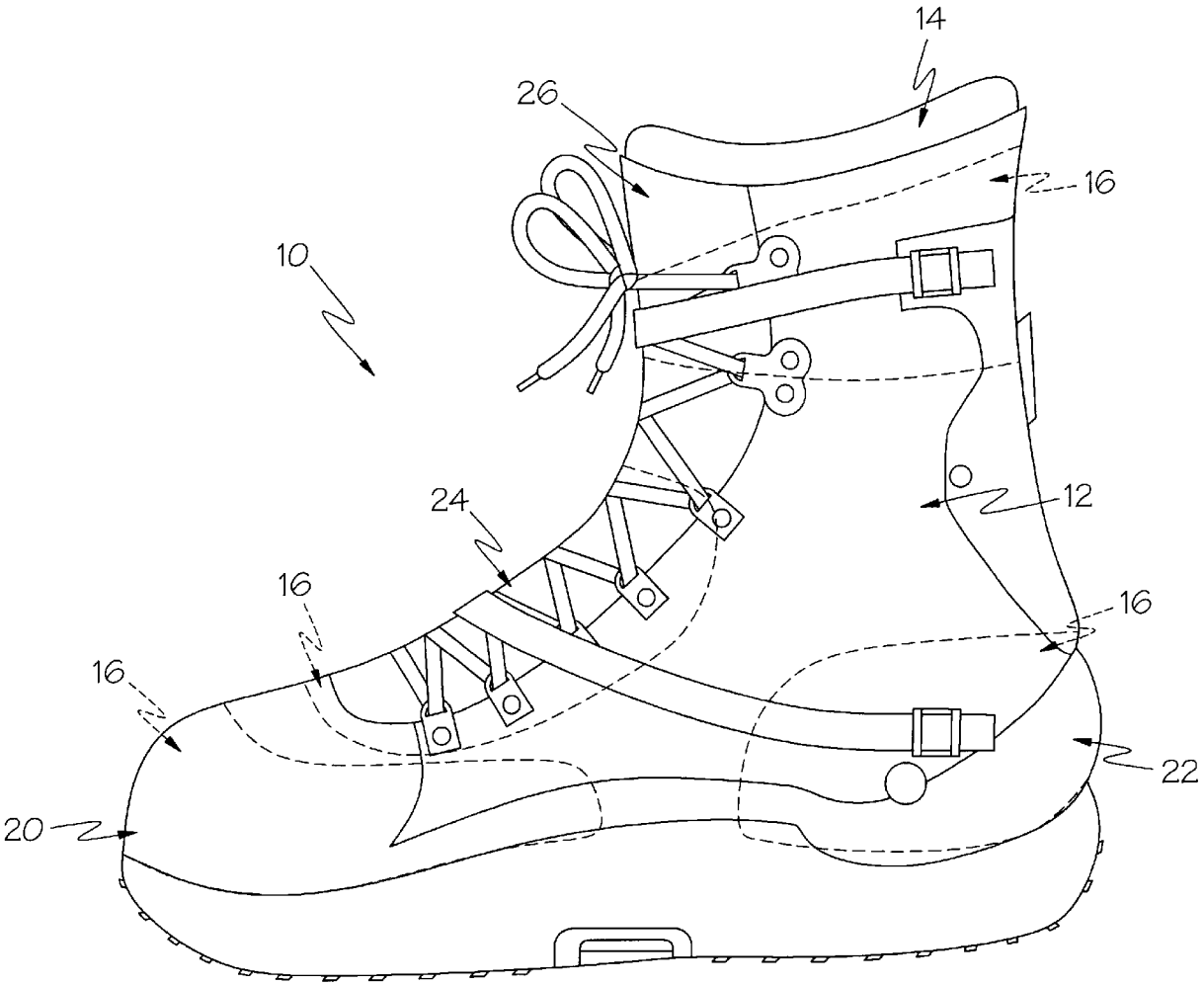
FIG. 1 is a side elevational view of the snowboard boot having inflatable bladders of the present invention.

A first embodiment of the snowboard boot of the present invention is indicated generally by the numeral 10 in FIGS. 1–5. Boot 10 generally includes an outer boot shell 12 formed generally in the shape of a human foot. Boot shell 12 may be substantially rigid or fabricated from a plurality of substantially rigid interlocking elements. Boot shells 12 are known in the art of snowboarding boots and ski boots and those skilled in the art recognize that such boots may be fabricated from a variety of materials such as any of a variety of plastics. Boots having similar shells are disclosed in U.S. Pat. Nos. 5,692,321 and 5,727,338. Boot shell 12 protects the snowboarder's foot 13 from impact forces and scratches. Boot shell 12 also forms a secure connection between the snowboard 15 and boot 10. A secure connection between the snowboard and boot 10 is important because the movements of the snowboarder are transferred to the snowboard through boot 10.

Boot 10 further includes a flexible interior mold 14 that molds to the snowboarder's foot to provide a secure fit between the snowboarder's foot and boot 10. Molds 14 are known to those skilled in the art and may be fabricated from any of a variety of materials. In accordance with the objectives of the present invention, boot 10 of the present invention further includes a plurality of selectively inflatable and deflatable bladders 16 distributed throughout the critical areas of boot shell 12 to allow the user to adjust the fit between boot 10 and his foot.

The construction of bladders 16 is known in the art. Bladders 16 may be fabricated from a pair, of opposed gas-impervious sheets having their edges welded together to form a bladder. Many bladders are fabricated from gas-impervious plastic sheets. An inlet may be provided before or after the welding to allow the bladder to be inflated and deflated. The edges of the opposed gas-impervious sheets may also be connected together with an adhesive. Although the material and construction of bladders 16 may vary in the present invention, each bladder 16 must be strong and durable enough to withstand the numerous forces imparted against bladder during a strenuous snowboard ride.

Boot shell 12 generally includes a toe portion 20, a heel portion 22, a top portion 24, and an ankle portion 26. As may be seen in the drawings, each portion 20, 22, 24, and 26 of boot shell 12 corresponds to the location of the snowboarder's toes, heel, top of foot, and ankle when the snowboarder's foot and ankle are received in boot 10.

In the preferred embodiment of the present invention, four selectively inflatable and deflatable air bladders 16 are mounted in boot 10. For purposes of clarity, bladders 16 are referred to as first bladder 30, second bladder 32, third bladder 34, and fourth bladder 36. Although the following description locates first, second, third, and fourth bladders at specific locations about boot shell 12, it is understood that first bladder 30 may be disposed at any of portions 20, 22, 24, or 26 without departing from the concepts of the present invention. Similarly, second, third, and fourth bladders 32, 34, and 36 may be disposed at any of portions 20, 22, 24, or 26 without departing from the concepts of the present invention.

Figure 2:
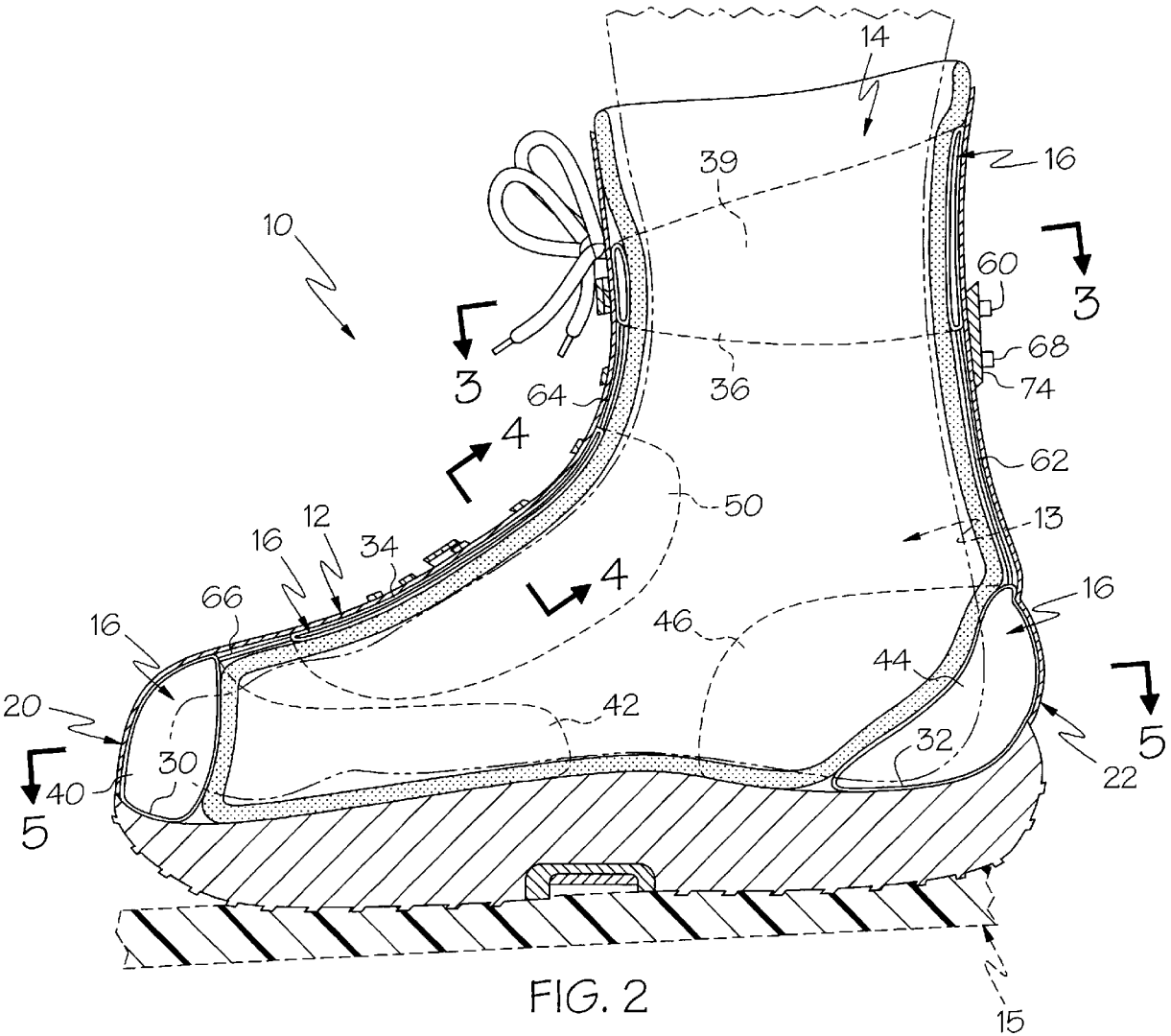
FIG. 2 is a side sectional view of the boot of FIG. 1 shown along with a snowboard and a user's foot and ankle in phantom lines.
Figure 5:
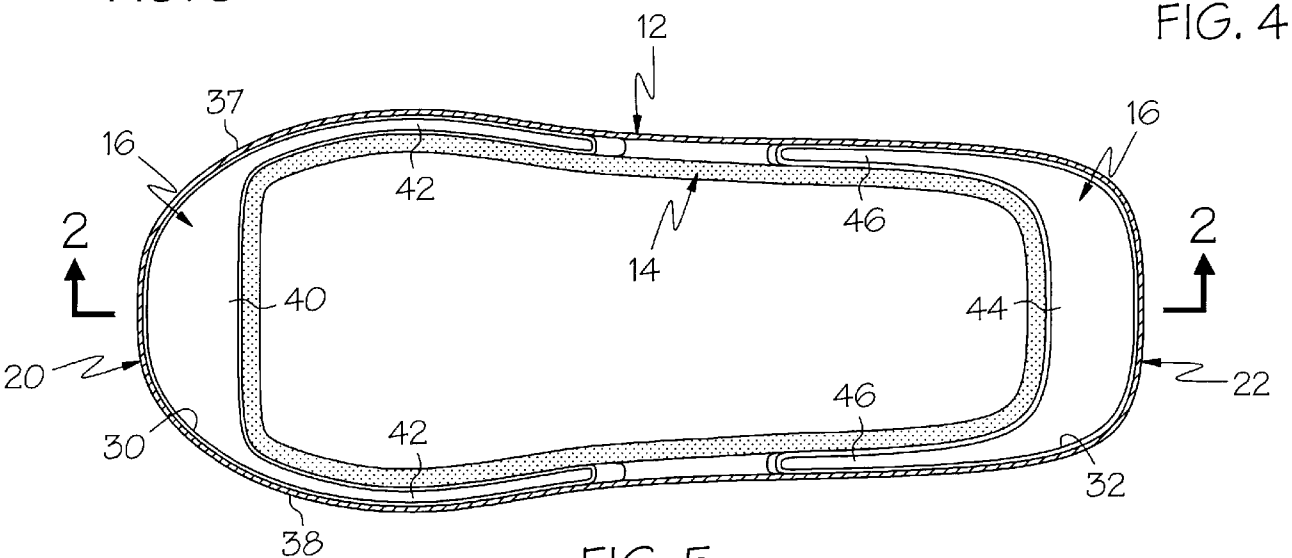
FIG. 5 is a sectional view taken along line 5—5 of FIG. 2.

In the exemplary embodiment, first bladder 30 is disposed at toe portion 20 having sides 37 and 38 as shown in FIGS. 2 and 5. First bladder 30 includes a main body 40 and a pair of extensions 42. Extensions 42 are disposed along the side of toe portion 20 as clearly shown in FIG. 5. Main body 40 and extensions 42 thus substantially surround the user's toe and forward portion of the user's foot when the user's foot is inserted within boot 10.

Second bladder 32 is disposed at heel portion 22 as shown in FIGS. 2 and 5. Second bladder 32 includes a main body 44 and pair of extensions 46 that extend along the sides of heel portion 22 as shown in FIG. 5. Extensions 46 thus surround the side portions of the user's heel when the user's foot is inserted into boot 10.

Figure 4:
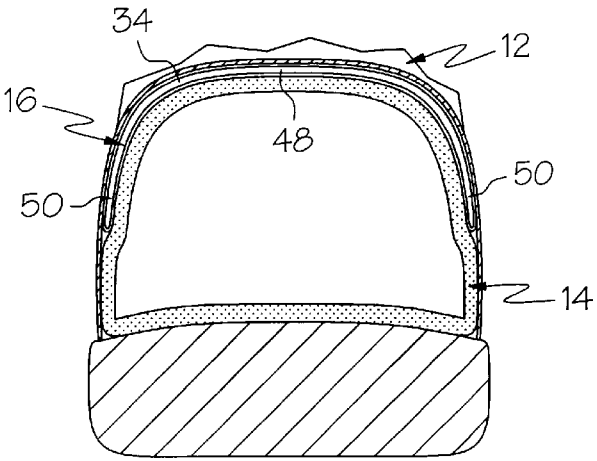
FIG. 4 is a sectional view taken along line 4—4 of FIG. 2.

Third bladder 34 is positioned at top portion 24 of boot shell 12 as shown in FIGS. 2 and 4. Third bladder 34 also includes a main body 48 and a pair of extensions 50 that extend down along the sides of the top portion 24 of boot shell 12 as shown in FIG. 4. Third bladder 34 thus snugly fits around the top of the user's foot when the user's foot is positioned within boot 10.

Figure 3:
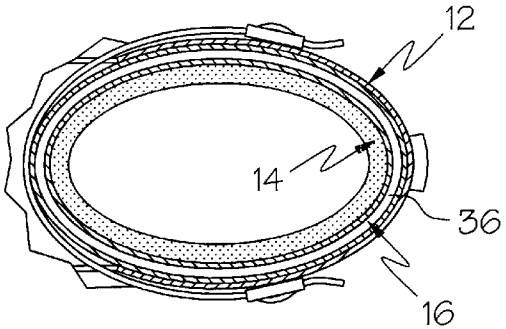
FIG. 3 is a sectional view taken along line 3—3 of FIG. 2.

Fourth bladder 36 is located at ankle portion 26 as shown in FIGS. 2 and 3. Fourth bladder 36 is ring-shaped and extends entirely around ankle portion 26 of boot shell 12 such that fourth bladder 36 will entirely surround the user's ankle 39 when the user's ankle and foot 13 are inserted into boot 10. As shown in FIG. 2, the front of fourth bladder 36 has a height that is substantially less than the rear of fourth bladder 36. In the preferred embodiment, the front of fourth bladder 36 is approximately one-half of the height of the rear of fourth bladder 36. This configuration gives fourth bladder 36 a taper providing a wider area of support at the rear or Achilles heel area of the user's 39 ankle and a narrower band of support at the front of the user's ankle 39. Bladder 36 allows the user to obtain a secure fit between his ankle 39 and boot 10 that prevents the user's foot 13 from pulling out of boot 10. This fit is one of the most important areas for boot 10 because snowboarders often jump up off of the snow while snowboarding.

As shown throughout the drawings, each bladder 16 is positioned between mold 14 and boot shell 12. This position protects bladder 16 and prevents bladder 16 from directly contacting the user's foot. The pressure and supporting force provided by bladder 16 is cushioned by mold 14 in this location. In another embodiment of the invention, bladder 16 may be embedded within mold 14 or positioned on the inside surface of mold 14. However, positioning bladder 16 between shell 12 and mold 14 allows mold 14 to be changed when it becomes worn.

In the embodiment of the invention depicted in FIGS. 1–5, a single air inlet 60 is provided in fluid communication with bladders 30, 32, 34, and 36. The fluid communication between each of bladders 30, 32, 34, and 36 is provided by first 62, second 64, and third 66 air lines as shown in FIG. 2. Air lines 62, 64, and 66 allow inlet 60 to inflate each of bladders 30, 32, 34, and 36. A release 68 allows air to be removed from each of bladders 30, 32, 34, and 36. In this embodiment, a handheld pump 70 (FIG. 7) is provided to selectively connect to air inlet 60 and release 68. Air inlet 60 may also be configured to cooperate with a standard container of carbon dioxide that automatically fills bladders 16. Each of air inlet 60 and release 68 includes a valve that regulates the flow of air into and out of bladder 16. The tip 72 of pump 70 is configured to interact with the valves of air inlet 60 and release 68 to move the valves from a closed to an open position. Release 68 may also be configured to be mainly operated simply by pushing release 68 to release air from bladder 16.

In another embodiment of the invention, the pump for increasing the pressure in each of bladders 30, 32, 34, and 36 is built into shell 12 as depicted schematically in FIG. 2. Pumps of this type are known in the art and can be fabricated to be small enough to be mounted on the rear portion of shell 12 as depicted in FIG. 2. When pump 74 is built into shell 12, air inlet 60 may be provided as a back up.

In another embodiment of the invention, each bladder 30, 32, 34, and 36 includes an individual air inlet and release 80, 82, 84, and 86, respectively. Each inlet/release 80, 82, 84, and 86 is configured to cooperate with pump 70 to allow air to be selectively inserted and removed from each of bladders 30, 32, 34, and 36. This configuration allows the user to regulate the amount of pressure in each bladder 16 individually.

Figures 6, 7:
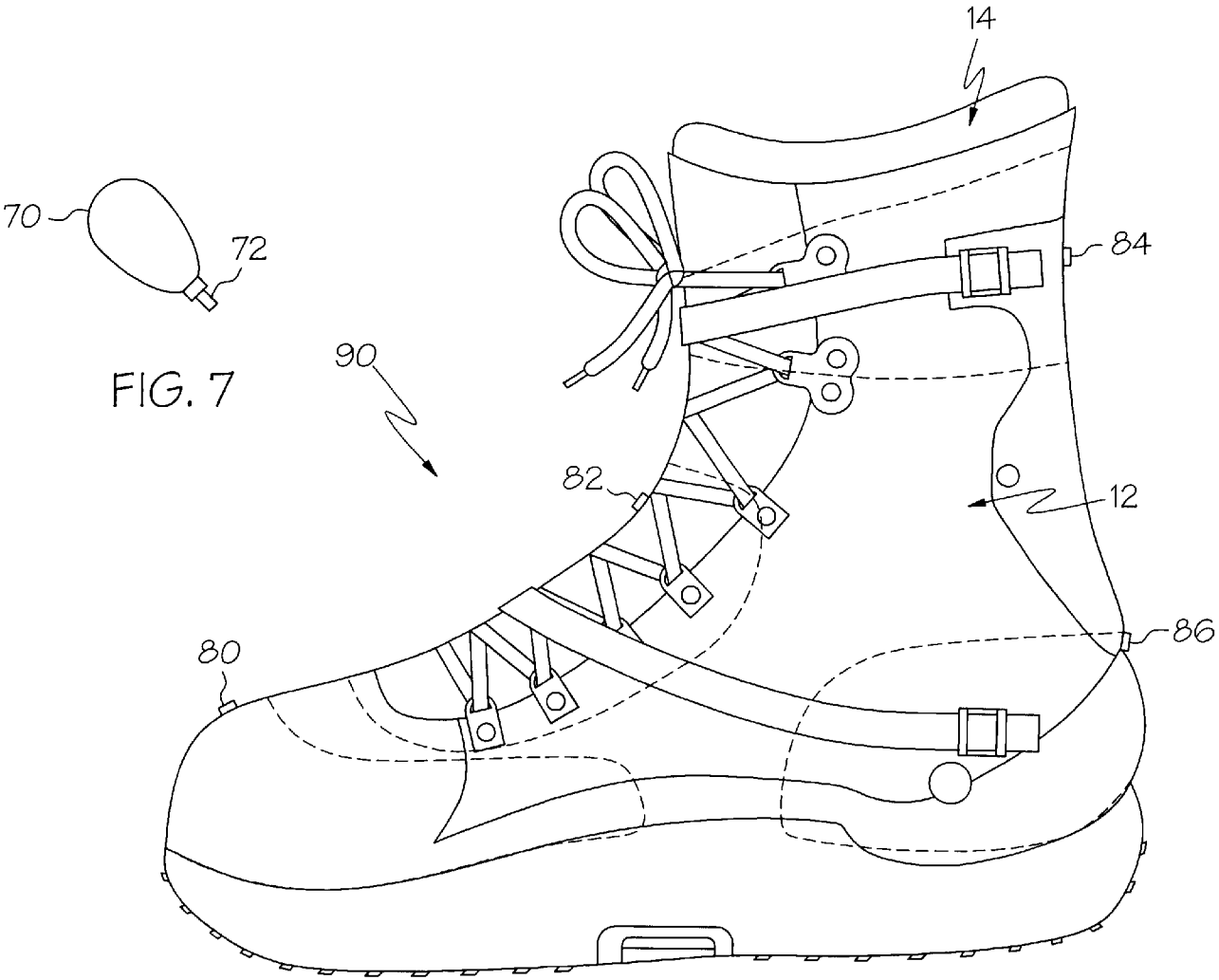
FIG. 6 is a view similar to FIG. 2 showing an alternative embodiment of the invention wherein each of the bladders is individually inflatable and deflatable.
FIG. 7 is a view of a manual hand pump used to inflate the bladders.

This embodiment of the boot is indicated generally by the numeral 90 is FIG. 6 and includes many of the same numbered elements as boot 10 with the addition of air inlet/releases 80, 82, 84, and 86. Each air inlet/release 80, 82, 84, and 86 includes a valve that allows air to be directed into bladder 16 but prevents air from escaping from bladder 16 until the release is activated. Boot 90 lacks air line 62, 64, and 66. Bladders 30, 32, 34, and 36 of boot 90 operate independently allowing the user of boot 90 to completely deflate one or more of bladders 16 while inflating other bladders 16. The user may also selectively add pressure to the toes, heel, top of foot, or ankle as needed. Although air inlet/releases 80, 82, 84, and 86 are disposed at different areas of boot 90 in the embodiment depicted in FIG. 6, air inlet/releases 80, 82, 84, and 86 may be disposed in a common location at the back or top of boot 90. When grouped together, each air inlet/release 80, 82, 84, and 86 is labeled and air lines extend to the respective bladders 16.

Boot 10 is used by the snowboarder by first deflating each bladder 16 so that the snowboarder's foot may be easily inserted into boot 10. The snowboarder then arranges his foot until comfortable. The snowboarder then inflates bladders 16 to provide a secure fit between his foot and boot 10. Bladders 16 may be inflated automatically by using a carbon dioxide cartridge or manually with pump 70 or pump 74. If the inflation pressure is too tight, the pressure in bladders 16 may be released.

In boot 90, the snowboarder also must deflate each bladder 16 before inserting his foot. After the foot is inserted, the snowboarder selectively inflates bladders 30, 32, 34, and 36 as needed to provide a secure fit. Thus, if the snowboarder needs a tighter fit at the top of his foot, he adds more pressure to third bladder 34. If the ankle bladder 36 is to tight, he may release pressure from bladder 36 without changing the pressure in the other bladders 30, 32, and 34. Boot 90 thus allows the snowboarder to custom fit boot 90 to his foot each time it is put on.

Accordingly, the improved Snowboard Boot With Inflatable Bladders apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the Snowboard Boot With Inflatable Bladders is constructed and used, the characteristics of the construction, and the advantageous new and useful results obtained; the new and useful structures, devices, elements, arrangements, parts, and combinations are set forth in the appended claims.

What is claimed is:

1. A snowboarding boot adapted to be worn on the foot and ankle of a user; the snowboarding boot comprising:

a boot shell having a toe portion, a heel portion, an ankle portion, and a top portion;

the heel portion of the boot shell having sides;

the top portion of the boot shell having sides;

the toe portion of the boot shell having sides;

a first selectively inflatable bladder disposed at the ankle portion of the boot shell;

the first selectively inflatable bladder being a continuous ring and adapted to surround the user's ankle when the user is wearing the snowboarding boot;

a first air inlet/release connected to the first bladder and extending outside the boot shell; and a flexible mold disposed inside the boot shell; the first selectively inflatable bladder being disposed between the boot shell and the flexible mold;

the ring-shaped first inflatable bladder having a front and a rear; the front of the ring-shaped selectively inflatable bladder being disposed lower than the rear of the ring-shaped selectively inflatable bladder;

the front of the ring-shaped selectively inflatable bladder having a height and the rear of the ring-shaped selectively inflatable bladder having a height; the height of the front being one-half of the height of the rear;

the ring-shaped selectively inflatable bladder being tapered from rear to front.

2. The snowboarding boot of claim 1, further comprising a second selectively inflatable bladder disposed at the heel portion of the boot shell; and the second selectively inflatable bladder having a pair of extensions disposed around the heel portion of the boot shell.

3. The boot of claim 2, further comprising a third selectively inflatable bladder disposed at the top portion of the boot shell; and a third air inlet/release connected to the third bladder; the third air inlet/release having a portion extending outside the boot shell; the third air inlet/release allowing the third selectively inflatable bladder to be inflated and deflated independent of the first and second selectively inflatable bladders.

4. The boot of claim 3, wherein the third selectively inflatable bladder disposed at the top portion of the boot shell includes a pair of extensions that are disposed along the sides of the top portion of the boot shell.

5. The boot of claim 4, further comprising a fourth selectively inflatable bladder disposed at the toe portion of the boot shell; and a fourth air inlet/release connected to the fourth bladder.

6. The boot of claim 5, wherein the fourth selectively inflatable bladder includes a pair of extensions that around the sides of the toe portion of the boot shell.

* * * * *